US011852301B1

(12) United States Patent
Al-Juaid et al.

(10) Patent No.: US 11,852,301 B1
(45) Date of Patent: Dec. 26, 2023

(54) VENTING SYSTEMS FOR PIPELINE LINERS

(71) Applicant: SAUDI ARABIAN OIL COMPANY, Dhahran (SA)

(72) Inventors: Mazen A. Al-Juaid, Khurais (SA); Ashiff Khan, Khurais (SA); Abdullah Al-Nami, Khurais (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/059,328

(22) Filed: Nov. 28, 2022

(51) Int. Cl.

| | |
|---|---|
| ***F17D 3/12*** | (2006.01) |
| ***F17D 1/07*** | (2006.01) |
| *E21B 43/10* | (2006.01) |
| *E21B 43/112* | (2006.01) |
| *E21B 43/11* | (2006.01) |

(52) U.S. Cl.
CPC ..... *F17D 3/12* (2013.01); *F17D 1/07* (2013.01); *E21B 43/10* (2013.01); *E21B 43/11* (2013.01); *E21B 43/112* (2013.01); *E21B 2200/09* (2020.05)

(58) Field of Classification Search
CPC ... F17D 3/12; F17D 1/07; E21B 43/10; E21B 43/11; E21B 43/112; E21B 2200/09
USPC ..... 137/13; 166/233, 236; 138/139, 114, 138/112
See application file for complete search history.

(56) References Cited

U.S. PATENT DOCUMENTS 4,688,589 A * 8/1987 Brainerd ..... F17D 3/12 137/13
4,722,363 A * 2/1988 Allyn ..... G05D 11/03 137/892
4,771,829 A * 9/1988 Sparlin ..... B01D 29/48 166/236
5,361,797 A * 11/1994 Crow ..... F17D 1/17 137/13
5,525,133 A 6/1996 Haukeness
5,762,137 A * 6/1998 Ross ..... E21B 23/02 166/228
8,082,986 B2 * 12/2011 Heidenreich ..... E03B 3/20 166/228
8,701,757 B2 * 4/2014 Greci ..... E21B 43/088 166/227

(Continued)

FOREIGN PATENT DOCUMENTS

WO 2002001103 A1 1/2002

OTHER PUBLICATIONS

Talesnick, Mark L. and Rafael Baker. "Failure of a flexible pipe with a concrete liner." Engineering Failure Analysis 5 (1998): 247-259.

*Primary Examiner* — Minh Q Le

(74) *Attorney, Agent, or Firm* — Vorys, Sater, Seymour and Pease LLP

(57) ABSTRACT

A pipeline system includes a pipeline, and a liner arranged within the pipeline, and a pipeline fluid is conveyed within the interior of the pipeline and a portion of the pipeline fluid permeates the liner as permeated fluid and enters an annulus defined between the liner and the pipeline. A venting system includes an active reinjection system that includes a reinjection line that receives the permeated fluid from the annulus, a suction line extending from the reinjection line to receive a portion of the permeated fluid, and a fluid pump that receives the portion of the permeated fluid and discharges the permeated fluid into the interior of the pipeline.

15 Claims, 2 Drawing Sheets

(56) References Cited

U.S. PATENT DOCUMENTS

| | | | | |
|---|---|---|---|---|
| 2002/0104650 | A1* | 8/2002 | Dusterhoft | E21B 43/10 166/227 |
| 2004/0221984 | A1* | 11/2004 | Cram | E21B 43/08 166/227 |
| 2010/0068986 | A1* | 3/2010 | Eccleston | G01M 3/283 454/339 |
| 2010/0108321 | A1 | 5/2010 | Hall et al. | |
| 2017/0335666 | A1* | 11/2017 | Weber | E21B 19/16 |
| 2019/0284906 | A1* | 9/2019 | Wang | F17D 1/14 |
| 2022/0010628 | A1* | 1/2022 | Shariff | F16L 55/24 |

* cited by examiner

VENTING SYSTEMS FOR PIPELINE LINERS

FIELD OF THE DISCLOSURE

The present disclosure relates generally to pipelines and, more particularly, to venting and recirculation systems for pipeline liners to prevent liner collapse.

BACKGROUND OF THE DISCLOSURE

Pipelines in the oil and gas industry commonly convey highly corrosive fluids, such as hydrocarbons (i.e., oil and gas), which, over time, can damage the structural integrity of the pipes. To avoid corrosive damage from such fluids, pipelines can be constructed from materials that are generally resistant to corrosion, such as stainless steel, duplex and super-duplex steels. Such materials, however, are cost prohibitive for most applications.

Another way to help prevent internal corrosion of pipelines is to line the interior of the pipeline with a liner. Pipeline liners have a relatively low initial cost and offer good protection of pipes of any material from the corrosive ingredients in fluids conveyed through the pipeline.

In oilfield transport service, or even in other services where gaseous materials are commonly transported under pressure, lined pipelines are commonly fitted with a vent that allows gases accumulated in the annular space (annulus) between the liner and the metal pipe to be vented. The vented gases can either be released to atmosphere or stored in a collection vessel or depressurized to pipeline from time to time. Periodically venting the gases accumulating in the annulus is intended to avoid excessive pressure on the liner, which could irreversibly collapse when pressure in the annulus exceeds the capacity of the liner and otherwise exceeds the pressure within the interior of the pipeline.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a pipeline system can include a pipeline, a liner arranged within the pipeline and thereby defining an interior of the pipeline, wherein a pipeline fluid is conveyed within the interior of the pipeline and a portion of the pipeline fluid permeates the liner as permeated fluid and enters an annulus defined between the liner and the pipeline. A venting system is included in the system for removing the permeated fluid from the annulus, the venting system including an active reinjection system that includes a reinjection line in fluid communication with the annulus to receive the permeated fluid from the annulus, a suction line extending from the reinjection line to receive a portion of the permeated fluid, and a fluid pump that receives the portion of the permeated fluid and discharges the permeated fluid into the interior of the pipeline.

According to another embodiment consistent with the present disclosure, a method can include flowing a pipeline fluid within an interior of a pipeline, the pipeline including a liner arranged within the pipeline and thereby defining the interior, permeating the liner with a portion of the pipeline fluid and thereby accumulating a permeated fluid within an annulus defined between the liner and the pipeline, receiving the permeated fluid in a reinjection line in fluid communication with the annulus, drawing the permeated fluid into a fluid pump from a suction line extending from the reinjection line, and discharging the permeated fluid from the fluid pump and into the interior of the pipeline.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
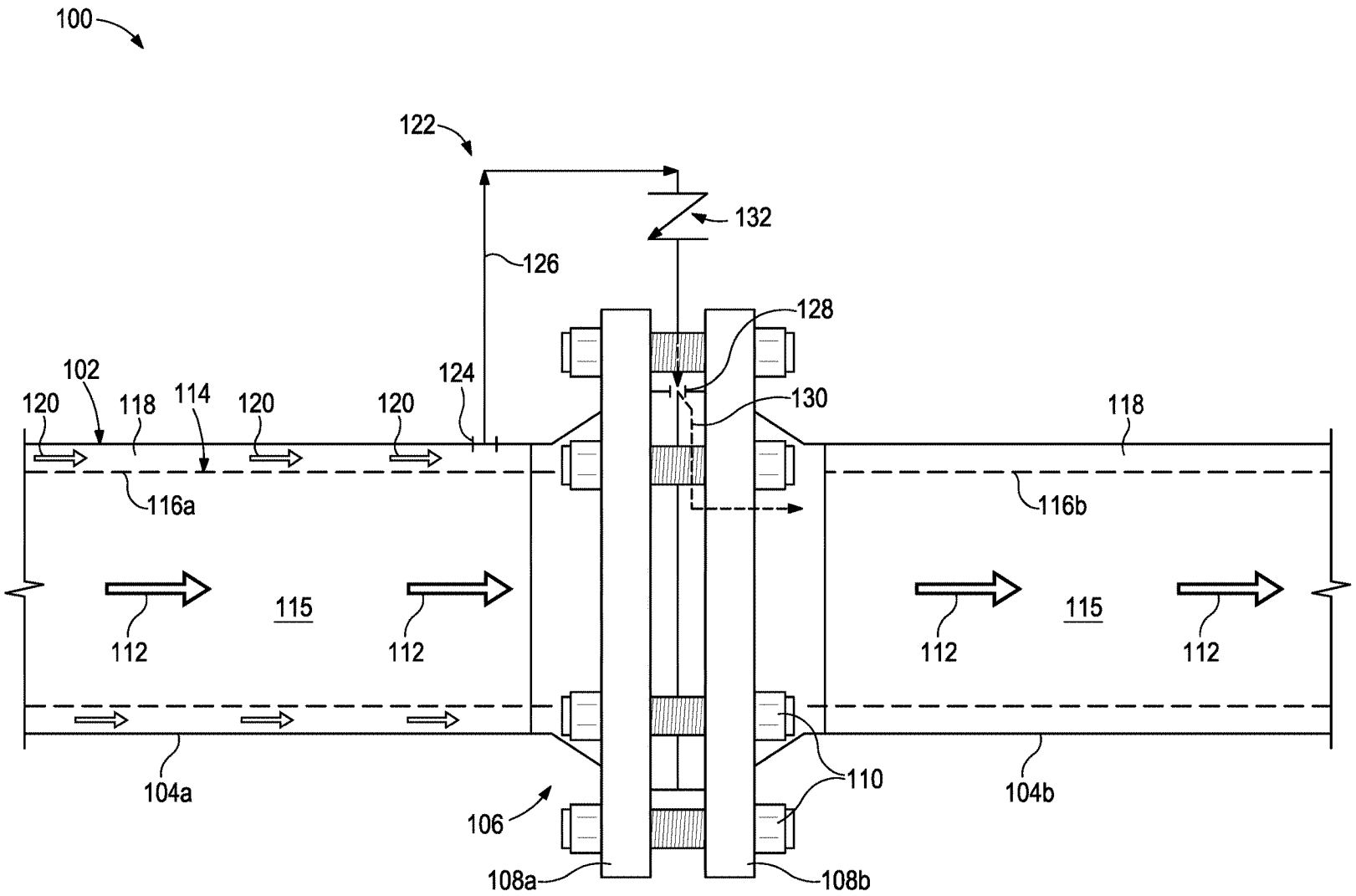
FIG. 1 (PRIOR ART)
FIG. 1 is a schematic side view of a prior art pipeline system.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments described herein are directed to venting systems for lined pipelines to help ensure continuous flow of permeated annular gas for the integrity of both the liner and the pipeline. The systems disclosed herein may be referred to as "active reinjection" systems.

FIG. 1 is a schematic side view of a prior art pipeline system 100 that may employ the principles of the present disclosure. The pipeline system 100 includes a pipeline 102 that may be made up of a plurality of pipes coupled end-to-end. In some cases, the pipeline 102 may exhibit a circular cross-section, as common to most pipes and tubulars in the oil and gas industry. However, the pipeline 102 could alternatively comprise a type of duct that exhibits a polygonal cross-section (e.g., square, rectangular, etc.).

The pipeline 102 includes first and second pipes 104*a* and 104*b* interconnected at a pipe flange joint 106. Each pipe 104*a,b* provides or otherwise defines a corresponding flange 108*a* and 108*b*, respectively, and the pipe flange joint 106 is formed by aligning and securing the flanges 108*a,b* together with a plurality of fasteners 110, such as sets of stud bolts and nuts. Each pipe 104*a,b* may comprise a tubular length of a rigid material, which could be a metallic or non-metallic material.

The pipeline 102 may be used to convey (transport) one or more pipeline fluids 112, which may comprise a liquid, a gas, or a combination of one or more liquids and one or more gases (i.e., a multiphase fluid). In one or more embodiments, the pipeline fluid 112 may comprise a fluid commonly conveyed in pipes or pipelines pertaining to the oil and gas industry, but could alternatively comprise fluids conveyed in other industries. Moreover, the pipeline fluid 112 may constitute a corrosive fluid, or otherwise a fluid having particular chemical properties that exhibit a corrosive or debilitating effect on the pipeline 102. Examples of the pipeline fluid 112 include, but are not limited to, a hydrocarbon (e.g., crude oil, natural gas, etc.), an aqueous acid (e.g., an acidizing fluid), an acid gas (e.g., carbon dioxide or hydrogen sulfide in a fluid phase), a salt solution, or any combination thereof.

To protect the pipeline 102 from the corrosive nature of the pipeline fluid 112, the pipeline system 100 includes a liner 114 arranged within all or a portion of the pipeline 102. The liner 114 may be configured to form an interference fit with the inner radial surface of the pipeline 102, even at low operating pressures, and thus substantially isolate the pipeline 102 from the pipeline fluid 112 and its corrosive or other effects (e.g., incompatibility of material with fluid). Accordingly, the liner 114 being arranged within the pipeline 102 essentially defines the interior 115 of the pipeline 102 through which the pipeline fluid 112 flows.

In the illustrated example, the liner 114 includes a first liner segment 116*a* positioned within the first pipe 104*a*, and a second liner segment 116*b* positioned within the second pipe 104*b*. In some applications, the liner 114 may extend through the pipe flange joint 106. In such applications, the liner segments 116*a,b* may form continuous, integral portions of the liner 114, but could alternatively be coupled or joined together at or near the pipe flange joint 106 or other locations. In other applications, the liner segments 116*a,b* may terminate at or near the pipe flange joint 106. In such applications, the annulus 118 defined between the first liner segment 116*a* and the first pipe 104*a* will not fluidly communicate with the annulus 118 defined between the second liner segment 116*b* and the second pipe 104*b*. In yet other applications, the first liner segment 116*a* may terminate at the pipe flange joint 106, and the second liner segment 116*b* may be omitted from the pipeline system 100, without departing from the scope of the disclosure.

The liner 114 may be made of a variety of materials including, but limited to, a polymer (e.g., high density polyethylene, medium density polyethylene, a polyamide, etc.), metal, concrete, or any combination thereof. In some cases, the liner 114 may be manufactured in a substantially tubular shape having an outside diameter that is the same as or slightly less than the inside diameter of the pipeline 102 and, more particularly, the pipes 104*a,b*. As indicated above, however, the pipeline 102 could alternatively exhibit a generally polygonal cross-section, and in such cases the liner 114 will correspondingly exhibit a polygonal cross-section to fit within the pipeline 102. The liner 114 could be cut to lengths convenient for handling and transport to the installation location, thus forming the individual liner segments 116*a,b*.

Over time, certain gases and/or liquids may permeate or diffuse through the liner 114 and migrate into the annulus 118 defined between the outer radial surface of the liner 114 and the inner radial surface of the pipeline 102. Such gases/liquids are referred to herein as "annular gas," or more broadly, permeated fluid 120, since it could include both gases and liquids. If a pressure of the permeated fluid 120 in the annulus 118 exceeds a pressure of the pipeline fluid 112 within the interior 115 of the pipeline 102, such as in the event internal pressure in the pipeline 102 is unexpectedly lost, the liner 114 could collapse toward the interior 115 and otherwise plastically deform. Collapse of the liner 114 is also more likely after assuming the stresses of installing the liner 114, which oftentimes results in the liner 114 losing its elastic properties and thereby making it more susceptible to mechanical yield.

Collapse of the liner 114 may be mitigated or entirely prevented by venting the permeated fluid 120 from the annulus 118. More specifically, the pipeline system 100 may further include a venting system 122 configured to receive the permeated fluid 120 from the annulus 118, and reinject the extracted permeated fluid 120 back into the interior 115 of the pipeline 102. The venting system 122 provides a means to monitor the performance and integrity of the liner system, while simultaneously facilitating the controlled reinjection of the permeated fluid 120 back into the interior 115 of the pipeline 102.

The venting system 122 can include a vent port 124 provided or otherwise defined on the first pipe 104*a* and in fluid communication with the annulus 118. A permeate jumper line or "reinjection line" 126 extends from the vent port 124 and provides a conduit to receive and redirect the permeated fluid 120 back into the interior 115 of the pipeline 102. As illustrated, the reinjection line 126 extends to a reinjection port 128 provided or otherwise defined on the pipe flange joint 106. The reinjection port 128 may be fluidly coupled to suitable plumbing and conduits 130 defined in (or through) the pipe flange joint 106 and thus configured to inject the permeated fluid 120 back into the interior 115 at the pipe flange joint 106. Once injected (re-introduced) into the interior 115, the permeated fluid 120 combines (mixes) with the pipeline fluid 112 as it is conveyed downstream.

In some applications, the venting system 122 may include one or more check valves 132 arranged within the reinjection line 126 and configured to ensure a controlled and safe venting of the permeated fluid 120 from the annulus 118 and into the interior 115. The check valve 132 may comprise a one-way check valve that prevents the pipeline fluid 112 within the interior 115 from entering the reinjection line 126 via the reinjection port 128.

Conveying the permeated fluid 120 through the reinjection line 126 and back into the interior 115 necessarily decreases the pressure within the annulus 118, which normalizes the pressure differential and thereby helps to avoid collapse of the liner 114. Accordingly, the venting system 122 operates to ensure that the pressure in the annulus 118 does not exceed the pressure within the interior 115 of the pipeline 102, which could lead to collapse of the liner 114. This may also help ensure that the pipeline 102 operates at steady operating pressure without excessive routine pressure cycling.

Figure 2:
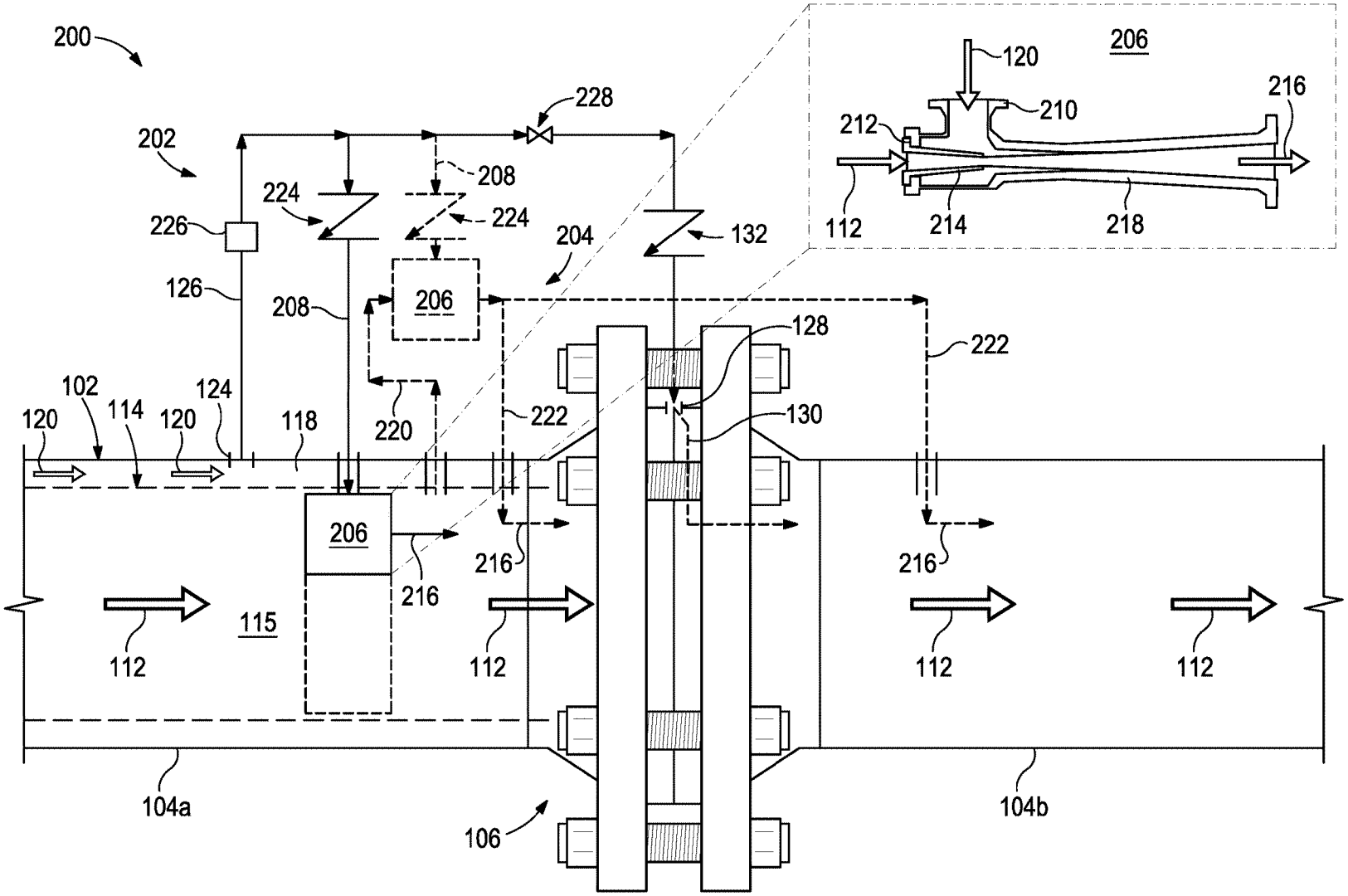
FIG. 2 is a schematic side view of an example pipeline system that may employ the principles of the present disclosure.

FIG. 2 is a schematic side view of an example pipeline system 200 that may employ the principles of the present disclosure. The pipeline system 200 may be similar in some respects to the pipeline system 100 of FIG. 1, and therefore may be best understood with reference thereto, where like numerals will correspond to similar components that may not be described again. Similar to the pipeline system 100, the pipeline system 200 includes the pipeline 102, which includes the first and second pipes 104*a,b* interconnected at the pipe flange joint 106. The pipeline 102 conveys (transports) the pipeline fluid 112, and the liner 114 is arranged within the pipeline 102 to help mitigate damage to the pipeline 102 due to the corrosive nature of the pipeline fluid 112. The permeated fluid 120 may also circulate within the annulus 118 defined between the liner 114 and the inner wall of the pipeline 102, and may present a risk of collapse of the liner 114 if the pressure within the annulus 118 exceeds the pressure of the pipeline fluid 112 within the interior 115 of the pipeline 102, as generally described above.

Unlike the pipeline system 100 of FIG. 1, however, the liner 114 is only present within the first pipe 104*a* (e.g., the first liner segment 116*a*), thus making the second pipe 104*b* an unlined section of the pipeline 102. However, the second liner segment 116*b* (FIG. 1) of the liner 114 could also be present in the second pipe 104*b*, without departing from the scope of the disclosure.

The pipeline system 200 includes a venting system 202 configured to receive the permeated fluid 120 from the annulus 118, and inject the extracted permeated fluid 120 into the interior 115 of the pipeline 102. The venting system 202 may be similar in some respects to the venting system 122 of FIG. 1, and therefore may be best understood with reference thereto, where like numerals will correspond to like components not described again in detail. As illustrated, for example, the venting system 202 includes the vent port 124 provided on the first pipe 104*a* and in fluid communication with the annulus 118, and further includes the reinjection line 126 extending from the vent port 124 to provide a conduit to receive the permeated fluid 120 from the annulus 118. In the illustrated embodiment, the reinjection line 126 extends to the reinjection port 128 provided at the pipe flange joint 106, but could alternatively extend to other reinjection ports, such as a port located on the second pipe 104*b*, without departing from the scope of the disclosure.

Unlike the venting system 122 of FIG. 1, however, the venting system 202 further includes an active reinjection assembly 204 designed to ensure continuous integrity for both the liner 114 and the pipeline 102. As illustrated, the active reinjection assembly 204 includes a fluid pump 206 in fluid communication with the reinjection line 126 via a suction line 208 extending from the reinjection line 126. In contrast to the system 100 of FIG. 1, which facilitates a passive reinjection method, the active reinjection assembly 204 may be operable to actively and continuously extract (draw) the permeated fluid 120 from the annulus 118 and discharge the permeated fluid 120 into the interior 115.

In some embodiments, the fluid pump 206 may comprise an ejector, also referred to as an eductor or jet pump. As shown in the inset graphic of FIG. 2, the ejector may be arranged to receive at least a portion of the permeated fluid 120 at a permeated fluid inlet 210. A portion of the pipeline fluid 112 is conveyed to a motive fluid inlet 212 as a "motive fluid" that exhibits a pressure greater than the pressure of the permeated fluid 120. In at least one embodiment, the motive fluid need not comprise the pipeline fluid 112, but could alternatively originate from another source of high-pressure fluid. The ejector utilizes the Venturi effect based on Bernoulli's principle of a converging-diverging nozzle 214 to convert the pressure energy of the high-pressure pipeline fluid 112 to velocity energy, which creates a low pressure zone within the ejector that draws in and entrains the lower-pressure permeated fluid 120 from the suction line 208. A mixture 216 of the permeated fluid 120 and the pipeline fluid 112 passes through the throat or diffuser 218 of the ejector, and the mixture 216 expands as its velocity is reduced, which recompresses the mixture 216 by converting velocity energy back into pressure energy. The ejector then discharges the mixture 216 at an intermediate pressure between the pressures of the permeated fluid 120 and the pipeline fluid 112. The mixture 216 is then received within the interior 115 of the pipeline 102 to combine (mix) with the pipeline fluid 112 as it is conveyed downstream.

In other embodiments, the fluid pump 206 may comprise a compressor, such as an electric-driven compressor system. In such embodiments, the compressor may be operated to provide a suction force that extracts (pulls) the permeated fluid 120 from the annulus 118, draws the permeated fluid 120 in from the suction line 208, and discharges the permeated fluid 120 back into the interior 115 of the pipeline 102 to combine (mix) with the pipeline fluid 112 as it is conveyed downstream.

In some embodiments, the fluid pump 206 may be arranged within the confines of the pipeline 102, thereby providing an "in-line" fluid pump system. In such embodiments, as illustrated, the fluid pump 206 may occupy only a portion of the flowpath of the interior 115. In other embodiments, however, such as when the fluid pump 206 comprises an ejector, the fluid pump 206 may occupy and otherwise occlude the entire flowpath defined by the interior 115, as shown by the dashed lines, such that all of the pipeline fluid 112 circulates through the fluid pump 206, without departing from the scope of the disclosure.

In other embodiments, the fluid pump 206 may be located outside of the pipeline 102, as shown in the dashed lines, thereby providing an "external" fluid pump system placed in fluid communication with the pipeline 102 via one or more conduits. In embodiments where the fluid pump 206 comprises an ejector, the suction line 208 will feed at least a portion of the permeated fluid 120 to the fluid pump 206 located outside of the pipeline 102, and a supply of the pipeline fluid 112 may be conveyed to the fluid pump 206 via a motive fluid line 220 extending from the interior 115 of the pipeline 102. The resulting mixture 216 discharged from the fluid pump 206 may be conveyed to the interior 115 via a discharge line 222 that communicably couples the discharge end of the fluid pump 206 with the pipeline 102. In some embodiments, the discharge line 222 may extend to the first pipe 104*a* and convey the mixture 216 into the first pipe 104*a*, but could alternatively extend to and convey the mixture into the second pipe 104*b*, without departing from the scope of the disclosure. Once introduced into the interior 115, the mixture 216 combines (mixes) with the pipeline fluid 112 as it is conveyed downstream.

In some embodiments, the active reinjection assembly 204 may further include one or more check valves 224 arranged within the suction line 208. The check valve(s) 224 may comprise a one-way check valve that allows the permeated fluid 120 to flow to the fluid pump 206, but prevents the permeated fluid 120 from reversing course within the suction line 208.

In some embodiments, the venting system 202 may further include a flow meter 226 arranged in the reinjection line 126 and configured to monitor the flow of the permeated fluid 120 escaping the annulus 118. The rate at which the venting system 202 relieves the permeated fluid 120 trapped in the annulus 118 can be monitored using the flow meter 226 to ensure that the venting rate during depressurization is sufficient to prevent positive pressure difference between the annulus 118 and the interior 115 of the pipeline 102.

Accordingly, the active reinjection assembly 204 may be designed to actively extract the permeated fluid 120 from the annulus 118 using the fluid pump 206, and discharge the mixture 216 of the permeated fluid 120 and the pipeline fluid 112 into the interior 115. Moreover, incorporating the active reinjection assembly 204 does not eliminate the passive venting system 122 of FIG. 1, which could be retained as a backup for the active reinjection assembly 204. For example, the venting system 202 may further include a valve 228 arranged in the reinjection line 126 at a location downstream from the take-off point of the suction line 208 from the reinjection line 126. The valve 228 can be normally open (NO) or normally closed (NC), depending on the pressure inside the pipeline 102 and the pressure within the annulus 118 during startup/shutdown conditions. With the valve 228 in the NO position, the permeated fluid 120 may be injected into the interior 115 via the reinjection line 126, but with the valve 228 in the NC position, the permeated fluid 120 will be drawn into the fluid pump 206 and eventually discharged into the interior 115 as part of the mixture 216 of the permeated fluid 120 and the pipeline fluid 112.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A pipeline system, comprising:

a pipeline;

a liner arranged within the pipeline and thereby defining an interior of the pipeline, wherein a pipeline fluid is conveyed within the interior of the pipeline and a portion of the pipeline fluid permeates the liner as permeated fluid and enters an annulus defined between the liner and the pipeline; and a venting system for removing the permeated fluid from the annulus, the venting system including an active reinjection system that includes:

a reinjection line in fluid communication with the annulus to receive the permeated fluid from the annulus;

a suction line extending from the reinjection line to receive a portion of the permeated fluid; and a fluid pump that receives the portion of the permeated fluid and discharges the permeated fluid into the interior of the pipeline.

2. The pipeline system of claim 1, wherein the pipeline comprises a first pipe and a second pipe interconnected at a pipe flange joint, and the liner comprises a first liner segment arranged within the first pipe, the annulus being defined between the first liner segment and the first pipe, and wherein the venting system further includes a vent port provided on the first pipe and in fluid communication with the annulus, the reinjection line extending from the vent port.

3. The pipeline system of claim 1, wherein the fluid pump is arranged within the interior of the pipeline.

4. The pipeline system of claim 1, wherein the fluid pump is arranged outside the pipeline.

5. The pipeline system of claim 1, wherein the fluid pump comprises an ejector that receives the portion of the permeated fluid at a permeated fluid inlet, the fluid pump also receiving a motive fluid at a motive fluid inlet, wherein the fluid pump draws in the portion of the permeated fluid to mix with the motive fluid, and discharges a mixture of the permeated fluid and the motive fluid to be received in the interior of the pipeline.

6. The pipeline system of claim 5, wherein the motive fluid comprises a portion of the pipeline fluid and the active reinjection assembly further includes:

a motive fluid line extending from the interior of the pipeline to the motive fluid inlet to convey the portion of the pipeline fluid to the fluid pump; and a discharge line extending from a discharge end of the ejector to convey the mixture into the interior of the pipeline.

7. The pipeline system of claim 1, wherein the fluid pump comprises a compressor.

8. The pipeline system of claim 1, further comprising one or more check valves arranged in the suction line.

9. The pipeline system of claim 1, wherein the venting system further comprises a valve arranged in the reinjection line at a location downstream from a take-off point of the suction line from the reinjection line.

10. The pipeline system of claim 1, wherein the venting system further includes a flow meter arranged in the reinjection line and operable to monitor the flow of the permeated fluid escaping the annulus.

11. A method, comprising:

flowing a pipeline fluid within an interior of a pipeline, the pipeline including a liner arranged within the pipeline and thereby defining the interior;

permeating the liner with a portion of the pipeline fluid and thereby accumulating a permeated fluid within an annulus defined between the liner and the pipeline;

receiving the permeated fluid in a reinjection line in fluid communication with the annulus;

drawing the permeated fluid into a fluid pump from a suction line extending from the reinjection line; and discharging the permeated fluid from the fluid pump and into the interior of the pipeline.

12. The method of claim 11, wherein the fluid pump comprises an ejector, the method further comprising:

drawing in the permeated fluid from the suction line at a permeated fluid inlet of the ejector;

receiving a motive fluid at a motive fluid inlet of the ejector;

mixing the motive fluid with the permeated fluid within the ejector and thereby discharging a mixture of the permeated fluid and the motive fluid; and receiving the mixture in the interior of the pipeline.

13. The method of claim 12, wherein the motive fluid comprises a portion of the pipeline fluid and the fluid pump is arranged outside the pipeline, the method further comprises:

conveying the portion of the pipeline fluid to the ejector via a motive fluid line extending from the interior of the pipeline to the motive fluid inlet; and conveying the mixture into the interior of the pipeline via a discharge line extending from a discharge end of the ejector.

14. The method of claim 11, further comprising preventing the portion of the permeated fluid from reversing course within the suction line with one or more check valves arranged in the suction line.

15. The method of claim 11, further comprising monitoring the flow of the permeated fluid escaping the annulus with a flow meter arranged in the reinjection line.

* * * * *